US008845238B1

(12) United States Patent
Fontaine

(10) Patent No.: US 8,845,238 B1
(45) Date of Patent: Sep. 30, 2014

(54) TRENCH BOX AND PANEL ASSEMBLY THEREFOR

(76) Inventor: Roger F. Fontaine, Splendora, TX (US)

( * ) Notice: Subject to any disclaimer, the term of this patent is extended or adjusted under 35 U.S.C. 154(b) by 0 days.

(21) Appl. No.: 13/303,659

(22) Filed: Nov. 23, 2011

(51) Int. Cl.
*E02D 17/08* (2006.01)
*E02D 17/06* (2006.01)
*E02D 17/04* (2006.01)

(52) U.S. Cl.
USPC ..... 405/282; 405/272; 405/283

(58) Field of Classification Search
USPC ..... 405/272, 282, 283; 52/426, 562, 563
See application file for complete search history.

(56) References Cited

U.S. PATENT DOCUMENTS 1,629,718 A * 5/1927 Lockard et al. ..... 182/128
1,759,070 A * 5/1930 Tengstedt ..... 52/562
1,768,146 A * 6/1930 Ramey ..... 405/272
1,877,351 A * 9/1932 Meem ..... 405/282
1,895,985 A * 1/1933 Goldsborough ..... 405/282
2,260,811 A * 10/1941 Kozak ..... 403/19
2,341,757 A * 2/1944 Brenneman et al. ..... 52/562
2,588,901 A * 3/1952 Weikart ..... 403/292
2,922,283 A * 1/1960 Porter ..... 405/283
2,956,409 A * 10/1960 Wicke ..... 405/282
3,335,573 A * 8/1967 Ward ..... 405/282
3,353,852 A * 11/1967 Wood ..... 403/189
3,362,167 A * 1/1968 Ward ..... 405/282
3,490,187 A * 1/1970 Stauffer et al. ..... 52/481.1
3,554,306 A * 1/1971 Wilburn ..... 175/320
3,621,660 A * 11/1971 Krings ..... 405/282
3,705,644 A * 12/1972 Kawchitch ..... 198/664
3,992,887 A * 11/1976 Fisher ..... 405/283
4,002,035 A * 1/1977 Wright ..... 405/283
4,033,138 A 7/1977 Griswold
4,044,564 A 8/1977 Griswold
4,056,938 A 11/1977 Griswold
4,056,940 A 11/1977 Fisher
4,090,365 A * 5/1978 Nieber ..... 405/282
4,114,383 A * 9/1978 Nieber ..... 405/282
4,259,028 A * 3/1981 Cook ..... 405/282
4,691,818 A * 9/1987 Weber ..... 198/666
4,850,747 A * 7/1989 Morelli ..... 405/283
4,926,592 A * 5/1990 Nehls ..... 52/98
4,993,880 A 2/1991 Collins
5,107,648 A * 4/1992 Roby ..... 52/309.12
5,149,149 A * 9/1992 Wu ..... 285/402
5,203,135 A * 4/1993 Bastian ..... 52/848
5,277,522 A * 1/1994 Pertz ..... 405/283
5,290,129 A * 3/1994 Rody et al. ..... 405/282
5,310,290 A * 5/1994 Spencer ..... 405/283
5,465,929 A * 11/1995 Dooley ..... 248/68.1
5,741,091 A * 4/1998 St. George et al. ..... 405/283

(Continued)

FOREIGN PATENT DOCUMENTS

GB 2171735 A * 9/1986 ..... E02D 17/08
JP 55089532 A * 7/1980 ..... E02D 17/08
JP 05098645 A * 4/1993 ..... E02D 17/08

*Primary Examiner* — John Kreck
*Assistant Examiner* — Edwin Toledo-Duran
(74) *Attorney, Agent, or Firm* — Egbert Law Offices, PLLC

(57) ABSTRACT

A panel assembly of a trench box has a frame, a receptacle affixed within the frame, a connector having one end portion received in the receptacle at an opposite end portion extending outwardly of the frame, and a pipe having one end affixed to the opposite end portion of the connector member and extending outwardly therefrom. The connector member has a flange extending radially outwardly therefrom. This flange bears directly or indirectly against either or both of the receptacle and the frame.

3 Claims, 6 Drawing Sheets

(56) References Cited

U.S. PATENT DOCUMENTS

| | | | | |
|---|---|---|---|---|
| 5,899,319 | A * | 5/1999 | Jarnagin | 198/666 |
| 5,902,075 | A * | 5/1999 | Krings | 405/282 |
| 6,176,059 | B1 * | 1/2001 | Cantarano et al. | 52/578 |
| 6,227,752 | B1 * | 5/2001 | Friedrich | 403/192 |
| 6,443,665 | B1 * | 9/2002 | Kundel, Sr. | 405/283 |
| 6,474,911 | B1 * | 11/2002 | Krings | 405/282 |
| 6,565,288 | B1 * | 5/2003 | McCallion | 405/259.5 |
| 7,082,734 | B2 * | 8/2006 | Rowan | 52/656.1 |
| 7,101,119 | B2 * | 9/2006 | Cerda | 405/282 |
| 7,290,961 | B1 * | 11/2007 | Ottman et al. | 405/282 |
| 7,559,724 | B1 * | 7/2009 | Olen | 405/282 |
| 7,722,286 | B2 * | 5/2010 | Heald | 404/9 |
| 7,837,413 | B1 * | 11/2010 | Kundel, Sr. | 405/283 |
| 7,850,400 | B2 * | 12/2010 | Freitag et al. | 405/262 |
| 7,854,564 | B1 * | 12/2010 | Erickson | 403/379.3 |
| 2003/0012607 | A1 * | 1/2003 | Coday et al. | 405/272 |
| 2003/0190197 | A1 * | 10/2003 | Lanka | 405/272 |
| 2005/0161571 | A1 * | 7/2005 | Wood | 248/354.3 |
| 2011/0305529 | A1 * | 12/2011 | Riggle, Jr. | 405/283 |

* cited by examiner

TRENCH BOX AND PANEL ASSEMBLY THEREFOR

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to trench boxes. More particularly, the present invention the relates to panel assemblies as used in such trench boxes. Additionally, the present invention relates to connector arrangements whereby one panel of the trench box can be flexibly and securely mounted to another panel of the trench box.

2. Description of Related Art Including Information Disclosed Under 37 CFR 1.97 and 37 CFR 1.98.

The construction industry often desires to employ excavations of various types, such as foundations, trenches, and the like. Where excavations are made in the earth, it is desirable to support the upright sidewalls of the excavation against collapse or to protect a sheltered workspace in the event of collapse. Due to unstable soil conditions, improper sloping of an excavation and/or other unaccounted-for occurrences, landslides, and cave-ins ensue. These natural occurrences have been known to destroy equipment, postpone job completion and, more seriously, injure or kill the workers within the excavation. Consequently, trench excavation is recognized by the Occupational Safety and Health Administration as being an extremely hazardous construction operation and it has promulgated regulations directed to the manner in which excavations are created and to the structures used to support the excavation against side wall collapse.

The current practice in the industry is to place trench boxes inside an excavation site. The trench boxes are generally open at the bottom so that the excavation can continue while the boxes are in place and open at the top for easy access by men and machinery and easy removal of excavated materials. The primary structure of a trench box is comprised of opposing side panels that perform a shoring or shielding function by holding the side walls of the excavation in place so as to prevent the side walls from collapsing into the trench or hole in the ground created by excavating. Additionally, trench boxes usually have a plurality of bars or beams that traverse the lateral width of the trench box, attaching to opposing trench box panels and reinforcing or supporting the opposing panels, thus providing further protection from side wall collapse. These support bars are also known as spreader bars as they assist in keeping the panels sufficiently spread apart from each other.

It is often desirable that the width between the opposing panels be changed. Additionally, the trench boxes usually have a fixed width in which the spreader bars are rigidly secured, by welding, or otherwise, to the opposing side panels. When damage occurs to the trench boxes, it is very difficult to repair or replace the various components. Since the panels are secured to the welded collars, they occupy a great deal of space during transport and storage. Additionally, when damage occurs, it is very difficult to repair such trench boxes on-site.

Additionally, trench boxes that have fixed side walls and spreader bars are often very difficult to move. Conventionally, when the side panels bear against the earth formation, the frictional effect created thereby strongly resists any movement. As such, a need has developed whereby the trench boxes can be more easily manipulated so as to reduce this frictional effect and allow for an easier movement of the trench box from one location to another.

In the past, various patents have issued relating to such trench boxes. For example, U.S. Pat. No. 3,992,887, issued on Nov. 23, 1976 to W. A. Fisher, describes a trench shoring assembly with a force transferring accessory. There is a pair of spaced-apart side walls for vertical disposition within a trench. Spreader pipes and spreader collars interconnect the side walls and allow limited pivotal movement between the walls. Each side wall includes inner and outer metal plates connected to a plurality of interconnected structural members so as to define a main frame. The interconnected structural members include horizontally extending hollow metal beams including a top beam which extends longitudinally along the top of the side wall, a pair of intermediate beams parallel the hollow metal beam and a bottom beam.

U.S. Pat. Nos. 4,033,138, 4,044,564 and 4,056,938, issued to J. L Griswold, describe trench shoring assemblies with a stacking accessory. A hardwood insert is disposed within the top beam of the wall to prevent a collapse of the metal beam. A number of hollow beams extend perpendicularly to the horizontal beams and ribbed members extend perpendicularly to the horizontal beams. The side walls of the assembly have a tapered bottom portion which defines a triangularly-shaped pointed lower extremity extending between the ends of the bottom portion. A metallic bar is disposed at the pointed lower extremity and extends between the ends of the bottom portion and protects the bottom of the side wall against abrasion. A U-shaped member is welded to the main frame, and, in turn, a spreader collar is welded to the U-shaped member so that a force applied to the spreader collar is transferred directly to the main frame. Each spreader pipe spaces the side walls apart between two spreader collars to which the spreader pipe is attached by spreader pins. A plurality of flanges extend from a spreader pipe and are connected by locking pins to mating flanges which extend from another spreader pipe of another vertically stacked trench shoring assembly.

U.S. Pat. No. 4,056,940, issued on Nov. 8, 1977 to W. A. Fisher, shows a trench shoring assembly having first and second spaced walls having upper surfaces with third and fourth spaced walls stacked upon the upper surfaces of the first and second walls. A plurality of tubular collars project from the various walls and are aligned vertically at each end thereof. Spreader pipes interconnect these collar projections at one end of the assembly and a spreader assembly interconnects the stacked walls at the other end. The spreader assembly includes vertically-extending metal beams interconnecting the collars projecting from the walls and tie bars extending between the vertical beams at a position spaced well above the upper surfaces of the lower walls.

U.S. Pat. No. 4,259,028, issued on Mar. 31, 1981 to J. B. Cook, provides water and debris impermeable trench box panels. A lightweight foamed filler is located between the inner and outer panel surfaces in a trench box panel and between structural, vertical and horizontal elements.

U.S. Pat. No. 4,993,880, issued on Feb. 19, 1991 to J. Collins, describes a trench-box panel having an array of horizontal elongate "C-section" members one on top of another and welded together continuously along their lengths. The members are longitudinally staggered to leave spaces between the ends of alternate members at each side of the panel. Robust vertical angle-members and flat members are welded to the ends of the horizontal members to seal the ends of cavities inside the horizontal members.

U.S. Pat. No. 7,559,724, issued on Jul. 14, 2009 to J. D. Olen, teaches an adjustable and portable trench support for placement within a trench. This trench support includes a pair of support panels disposed within the trench and against the opposed trench walls. Support plates include, on their interior sides, a pair of support arm guides. Each support arm guide has a vertical channel and a number of offsets so that support arms can be slid within the channels and vertically positioned in the desired offsets. The pair of support arms are mounted to the support arm guides in support plate so as to have larger diameters than the support arms mounted to the opposite support arm guides so as to allow for the telescopic slidable insertion of the smaller diameter support arms into the larger diameter support arms.

U.S. Pat. No. 7,837,413, issued on Nov. 23, 2010 to R. Kundel, Sr., shows an adjustable trench box and spreader bar assembly which has male and female telescoping pipes. The male telescoping pipe has a plurality of indexed openings. The female telescoping pipe has an outer threaded portion with a groove to receive a locking pin. A sleeve is threadedly attached to the outer threaded portion of the female telescoping pipe. The sleeve has a sleeve opening and an inside channel for receiving the locking pin therethrough such that fine adjustments in the relationship between opposing panels of the trench box can be made by rotating the sleeve about the threaded portion of the female pipe for extension or retraction of the male pipe.

It is an object of the present invention to provide a trench box assembly that is easily stackable.

It is another object of the present invention to provide a trench box assembly that can be disassembled into a very compact configuration.

It is still another object of the present invention to provide a trench box assembly which is safer to transport.

It is still another object of the present invention to provide a trench box assembly wherein the components of the trench box assembly are reversible.

It is still another object of the present invention to provide a trench box assembly that provides greater flexibility at the joints between the spreader bars and the panels of the trench box.

It is still a further object of the present invention to provide a trench box assembly that is easier to dislodge and move when installed in the earth.

It is still a further object of the present invention to provide a trench box assembly which is easier to repair.

These and other objects and advantages of the present invention will become apparent from a reading of the attached specification and appended claims.

BRIEF SUMMARY OF THE INVENTION

The present invention is a panel assembly of a trench box that comprises a frame, a receptacle affixed within the frame, a connector having one end portion received in the receptacle at an opposite end portion extending outwardly of the frame, and a pipe having one end affixed to the opposite end portion of the connector member and extending outwardly therefrom. The connector member has a flange extending radially outwardly therefrom. This flange can bear against at least one of either the receptacle or the frame.

The receptacle is an annular member having an interior. The one end portion of the connector member is received within the interior of this annular member. The annular member has a hole extending diametrically thereacross. The one end portion of the connector member has a hole extending diametrically thereacross and aligned with the hole of the annular member. A first bolt extends through the holes of the annular member and the connector member so as to affix the connector member to the annular member. The pipe has a hole extending diametrically thereacross. The opposite end portion of the connector member has a hole extending diametrically thereacross in alignment with the hole of the pipe. A second bolt extends through the holes of the pipe and the opposite end portion of the connector member so as to affix the pipe to the connector member. The the first bolt has a longitudinal axis extending 90° offset from a longitudinal axis of the second bolt.

As used herein, the term "bolt" can also be used to refer to a "pin". For example, a pin with a threaded receptacle in the end could be used. Also, a special bolt with the threads near the head of the bolt could also be implemented. A pin tube could be welded to the receptacles during fabrication could also be used (so as to seal water and dirt from entering and filling the cavities in the beams). A plate with a hole at each end could cover the hole after the pin is inserted. The plate could be bolted in place.

The frame has a hole extending in alignment with the holes of the annular member and the one end portion of the connector member. The first bolt has an end extending outwardly of the frame.

The connector member is a tubular member. The one end portion of the connector member is slidably received within the receptacle. The end of the pipe bears against the flange of the connector member. The frame has a vertical member and a horizontal member affixed together so as to define a corner therebetween. The receptacle is affixed in the corner.

The present invention is also a trench box assembly that includes a first frame, a second frame extending in generally parallel relationship to the first frame, a first receptacle affixed to the first frame, a second receptacle affixed to the second frame, a first connector member having a first end portion received in the interior of the first receptacle and a second end portion extending outwardly therefrom, a second connector member having a first end portion received within the interior of the second receptacle and a second end portion extending outwardly therefrom, and a pipe having a one end affixed to the second end portion of the first connector member and to the second end portion of the second connector member.

In the trench box assembly of the present invention, the first connector member has a flange extending radially outwardly therefrom in a position between the first and second end portions thereof. Similarly, the second connector member has a flange extending radially outwardly therefrom in a position between the first and second end portions thereof. The flange of the first connector member bears against the first frame. The flange of the second connector member bears against the second frame. The pipe has a one end bearing against the flange of the first connector. The pipe has the opposite end bearing against the flange of the second connector member.

DETAILED DESCRIPTION OF THE INVENTION

Figure 1:
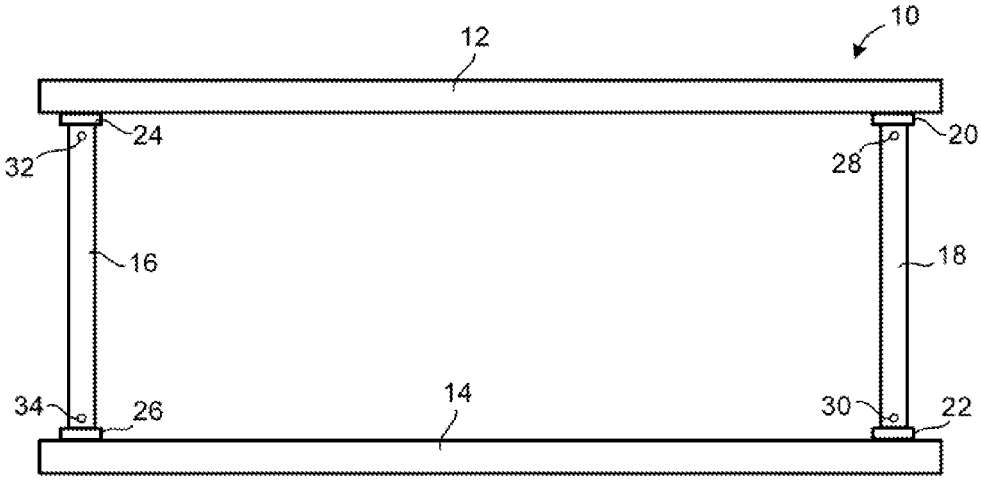
FIG. 1 is plan view showing the trench box assembly in accordance with the preferred embodiment of the present invention.

FIG. 1 shows the trench box assembly 10 in accordance with the preferred embodiment of the present invention. The trench box assembly 10 includes a first panel 12 and a second panel 14 arranged in generally parallel relationship to each other. A first spreader bar 16 will extend between panels 12 and 14. A second spreader bar 18 will extend between the panels 12 and 14 at an end thereof opposite the spreader bar 16.

Each of the panels 12 and 14 includes a frame therein that is covered by a skin or other rigid material. Typically, the panels 12 and 14 will reside against the walls of the excavation. The spreader bars 16 and 18 extend therebetween so as to assure that the panels 12 and 14 maintain their desired parallel relationship when installed in a trench.

In FIG. 1, it can be seen that there is a connector member 20 that is secured to the panel 12 adjacent one end thereof. Another connector member 22 is secured to the second panel 14 at an end of the spreader bar 18 opposite to the connector member 20. The connector members 20 and 22 will each have a configuration similar to that shown in the following FIGURES. It should be noted that the spreader bar 16 also has a connector member 24 that serves to secure the spreader bar 16 to the panel 12. Another connector member 26 serves to secure the end of the spreader bar 16 to the second panel 14.

Within the concept of the present invention, the spreader bars 16 and 18 are pipes. These pipes should have a suitably sturdy configuration so as to assure the structural integrity of the trench assembly 14. As will be described hereinafter, a bolt 28 serves to secure one end of the spreader bar 18 to the connector member 20. A bolt 30 serves to secure the opposite end of the spreader bar 18 to the connector member 22. A bolt 32 secures the end of the spreader bar 16 to the connector member 24. Additionally, a bolt 34 secures the opposite end of the spreader bar 16 to the connector member 26. Each of the connector members 24, 26, 28 and 30 will be retained within receptacles formed in the corners of the panels 12 and 14.

Figure 2:
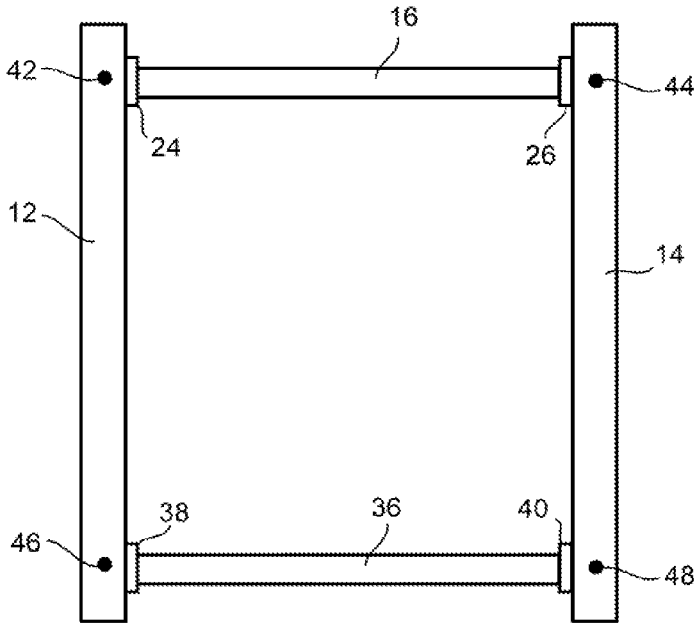
FIG. 2 is an end view of the trench box assembly of the present invention.

FIG. 2 shows an end view which particularly shows the arrangement of the panels 12 and 14. The spreader bar 16 is illustrated as extending between these panels 12 and 14. Another spreader bar 36 will extend between the panels 12 and 14 adjacent to a bottom thereof. Several spreader bars can be utilized within the construction of the trench box 10 in accordance with the present invention. Connector members 24 and 26 secure the spreader bar 16 adjacent to the upper corners of the panels 12 and 14. Connector members 38 and 40 secure the spreader bar 36 to the panels 12 and 14.

As can be seen in FIG. 2, a bolt 42 extends outwardly of the upper end portion of the panel 12. Bolt 42 affixes the connector 24 within the corner of the panel 12. Another bolt 44 extends outwardly of the panel 14 at the upper end thereof so as to secure the connector 26 within the corner of the second panel 14. Bolts 46 and 48 are illustrated as extending outwardly from the bottom end of the panels 12 and 14 so as to respectively secure the connector members 38 and 40 in the respective corners thereof.

Figure 3:
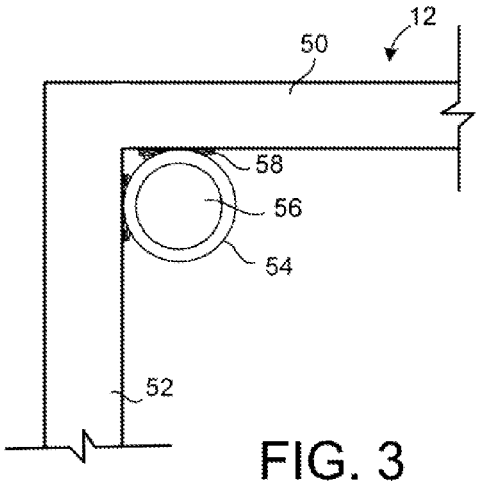
FIG. 3 is a detailed view showing the receptacle as affixed in the corner of a frame of a panel of the trench box assembly of the present invention.

FIG. 3 is a detailed view showing the placement of the receptacle 54 of the present invention in the corner between the horizontal frame member 50 and the vertical frame member 52 of the panel 12. The receptacle 54 is an annular member that has an interior 56 extending therethrough. The periphery of the receptacle 54 is secured by welding 58 to the corner between the horizontal frame member 50 and the vertical member 52. As such, the interior 56 is suitable for receiving the connector therein. The various corners of the trench box 10 will have a similar configuration.

Figure 4:
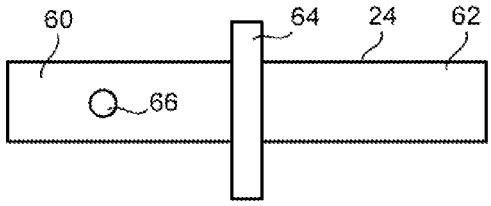
FIG. 4 is side elevational view of the connector member as used in the trench box assembly of the present invention.

FIG. 4 is side elevational view of the connector member 24. Connector member 24 has a first end portion 60 and a second end portion 62. The connector member 24 is a tubular member. A flange 64 will extend radially outwardly of the connector member 24 in a position between the end portions 60 and 62. A hole 66 will extend diametrically through the connector member 24 in the first end portion 60. The hole 66 allows the connector member 24 to be affixed with the interior 56 of the receptacle 54.

Figure 5:
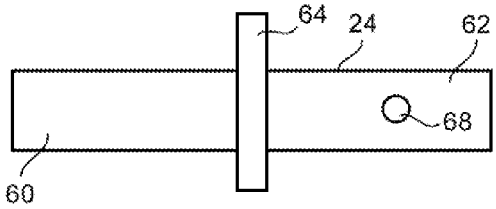
FIG. 5 is a plan view of the connector member as used in the trench box assembly of the present invention.

FIG. 5 is a plan view showing the connector member 24. The connector member 24 is illustrated as having a the first end portion 60 and the second end portion 62 with the flange 64 extending radially outwardly therefrom. A hole 68 is formed in the second end portion 62 and extends diametrically thereto. The hole 68 allows the second end portion 62 of the connector member 24 to be secured to the spreader bar 16. Hole 68 is offset by 90° from hole 66.

Figure 6:
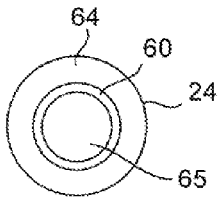
FIG. 6 is an end view of the connector member as used in the trench box assembly of the present invention.

FIG. 6 is an end view of the connector member 24. It can be seen that the first end portion 60 has a diameter that is less than the diameter of the flange 64. The first end portion 60 is of a tubular construction having an interior 65. The opposite end portion 64 of the connector member 24 will have a similar arrangement. As will be described hereinafter, the flange 64 provides a surface whereby the connector member 24 can suitably bear against the receptacle 54 and/or against the horizontal frame member 50 or the vertical frame member 52 of the panel 12.

Figure 7:
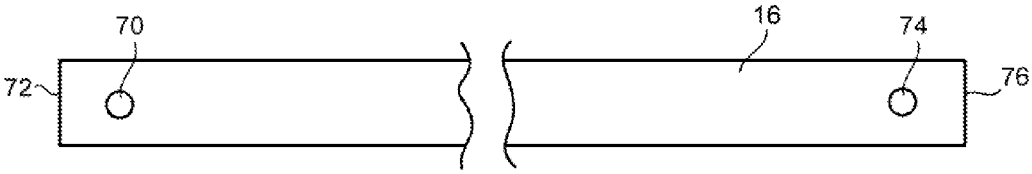
FIG. 7 is a plan view showing the pipe as used in the trench box assembly of the present invention.

FIG. 7 is an plan view of the spreader bar 16. The spreader bar 16 is a rigid pipe having a length dimension and a diameter. A hole 70 is formed adjacent to the end 72 of the spreader bar 16. A hole 74 is formed adjacent to the opposite end 76 of the spreader bar 16. Within the concept of the present invention, the spreader bar 16 can have various lengths depending on the desired construction of the trench box 10. When wider excavations are necessary, a spreader bar 16 of extended length can be employed. When a smaller distance between the side panels 12 and 14 is desired, then a shorter length dimension of the spreader bar 16 can be employed. As such, the pipe of the spreader bar 16 of the present invention can be utilized so that the user can properly adjust the distance between the side panels 12 and 14 of the trench box.

Figure 8:
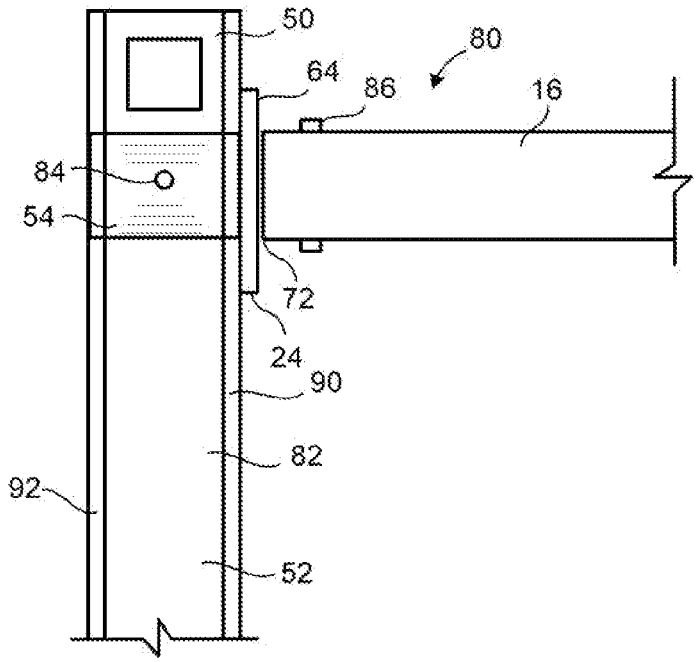
FIG. 8 is an end view as showing the panel assembly of the trench box of the present invention.

Referring to FIG. 8, the panel assembly 90 of the present invention is particularly illustrated. In particular, the inner surface 82 of the vertical frame member 52 is illustrated as having the receptacle 54 affixed thereto. The horizontal frame member 50 is illustrated as being of a box-type construction. The receptacle 54 is fitted against the underside of the horizontal frame member 50 and adjacent to the upper end of the vertical frame member 52.

In FIG. 8, it can be seen that the receptacle 54 has a bolt 84 with a head extending outwardly therefrom. The bolt 84 serves to secure the end portion 60 of the connector member 24 within the interior 56 of the receptacle 54. As such, a solid and fixed connection is easily established between the receptacle 54 and the end portion 60 of the connector member 24. The bolt 84 will extend through the wall of the receptacle 54 and through the hole 66 of the connector member 24. An opposite end of the bolt 84 will protrude outwardly of the opposite side of the vertical frame member 52 of the panel 12.

In FIG. 8, the flange 64 is illustrated as having an outer periphery bearing against the skin 90 of the vertical frame member 52 and against the skin 90 of the horizontal frame member 50. The flange 64 could also bear against the end surface of the receptacle 54. As such, the flange 64 will serve as a thrust plate so as to properly distribute forces that would bear upon the connector member 24 during the use of the trench box 10 of the present invention. The spreader bar (or pipe) 16 has one end 72 positioned adjacent to the surface of the flange 64 opposite to the receptacle 54. The open end of the pipe 16 will slide over the opposite end portion 62 of the connector member 24. Importantly, a bolt 86 is illustrated as extending through the hole 70 of the pipe 16 and through the corresponding and aligned hole 68 on the opposite end portion 62 of the connector member 24. As such, the end 72 of the pipe 16 will be rigidly fixed in position relative to the connector member 24.

Figure 9:
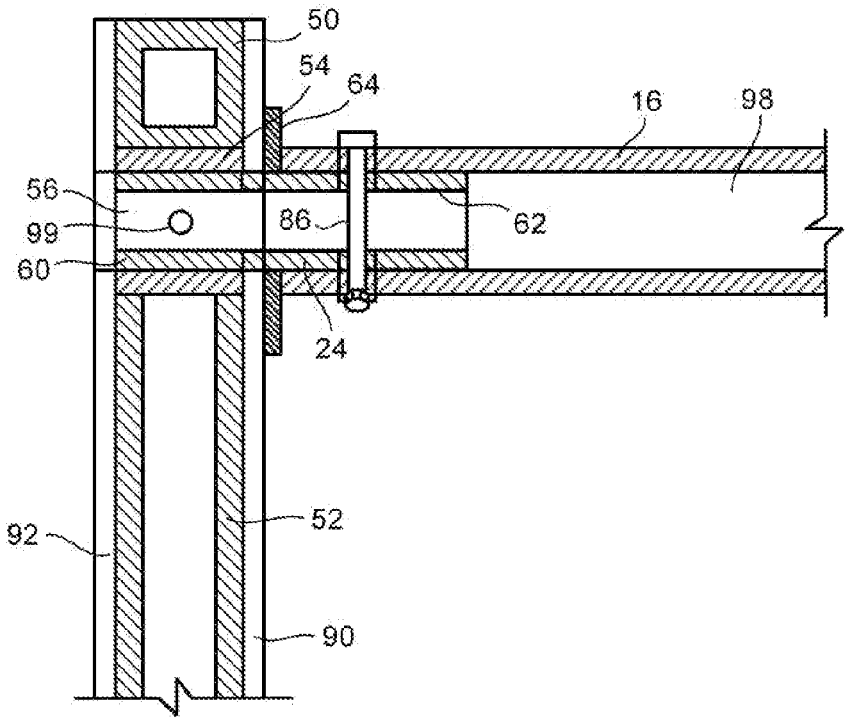
FIG. 9 is a cross-sectional view of the panel assembly of the trench box of the present invention.

FIG. 9 further illustrates a cross-section of the configuration of the present invention. In FIG. 9, it can be seen that the vertical frame member 52 has an inner skin 90 affixed thereto and an outer skin 92 affixed thereto. Both inner skin 90 and outer skin 92 have a hole so the skin can be welded to the end of the receptacle 54 with a fillet weld. The flange 64 rests against one of the skins 90 or 92 depending on which side the connector has been installed. The skin 90 or 92 transfers the forces from flange 64 to the inner members. The hole in the skin allows the receptacles of the present invention to be properly exposed. The receptacle 54 is illustrated as affixed against the underside of the horizontal frame member 50. The connector member 24 has its end portion 60 extending through the interior 56 of the receptacle 54. The hole 94 is illustrated as extending through the receptacle 54 and through the end portion 60 of the connector member 24 diametrically. The flange 64 bears against the skin 90 of the vertical frame member 52 and the horizontal frame member 50. The pipe 16 has its end positioned against the surface of the flange 64. The opposite end portion 62 of the connector member 24 extends through the interior 98 of the pipe 16. The opposite end portion 62 of the connector member 24 is illustrated as having holes extending diametrically therethrough. The bolt 86 will extend through these holes in the opposite end portion 62 and through the holes 70 of the pipe 16. As such, the bolt 86 has suitable nuts, or other fasteners, attached thereto whereby the pipe 16 is strongly joined to the connector member 24.

The configuration illustrated in FIG. 9 is applicable to all of the corners and/or sides of the trench box 10 of the present invention. The illustration of FIG. 9 merely shows how the various components can be assembled together so as to achieve the advantages of the present invention.

Figure 10:
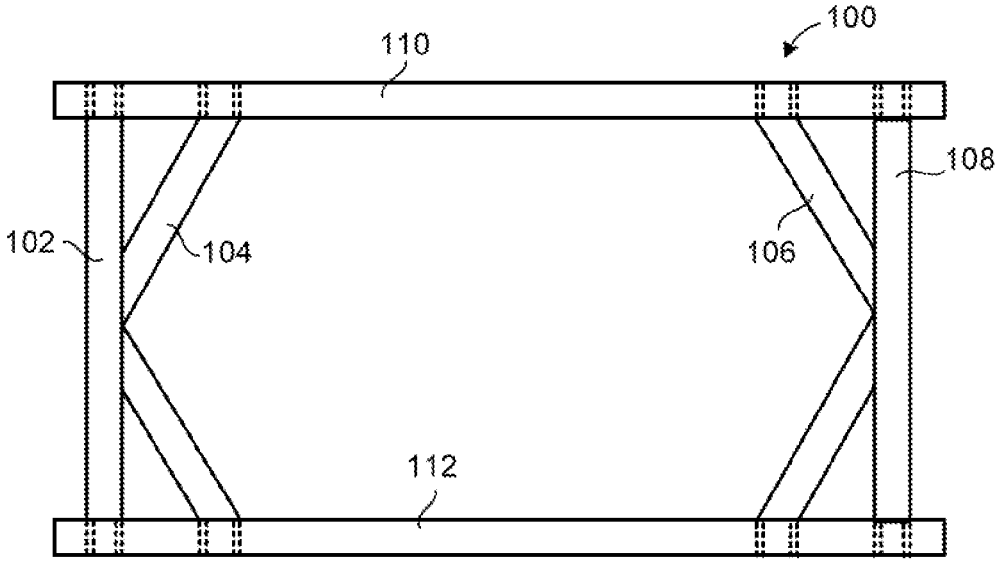
FIG. 10 is a plan view of a braced spreader bar assembly for use with a trench box.

FIG. 10 is a plan view of a braced spreader bar assembly of a trench box 100. As can be seen, the braced spreader bar assembly of trench box 100 includes spreader bars 102, 104, 106 and 108. The spreader bars 102 and 108 are linear members that have ends received in the side panels 110 and 112. The spreader bars 104 and 106 have a generally V-shaped configuration. The ends of the spreader bars 104 and 106 are received in the side panels 110 and 112 of the trench box 100. The apex of the spreader bars 104 and 106 extends toward the respective linear spreader bars 102 and 108.

Within the concept of the present invention, the various spreader bars can be of round tubing or also of square or rectangular tubing. Square or rectangular tubing is often used in heavier duty construction. A brace configuration of FIG. 10 has members extending generally at an angle to a lower place of a collar on the box wall. The braced spreader of FIG. 10 would not necessarily use a replaceable collar but would connect in the receptacles in the walls.

It can be seen in FIG. 10 that the braced spreader configuration has collar receptacles placed along the top of the side panels 110 and 112 so as to effectively reduce strain on the overall box length for large excavations when the brace spreader would be used in a horizontal position. This particular arrangement has not been used in the past because collars protruding from the wall would have restricted the use of the box when braces were not needed. Placing the receptacles in equal distances vertically and horizontally will allow the same spreader bars to be used in either position. Added receptacles can be applied on the end of the excavation structure such that the braced spreaders can be used in both manners at the same time.

Figure 11:
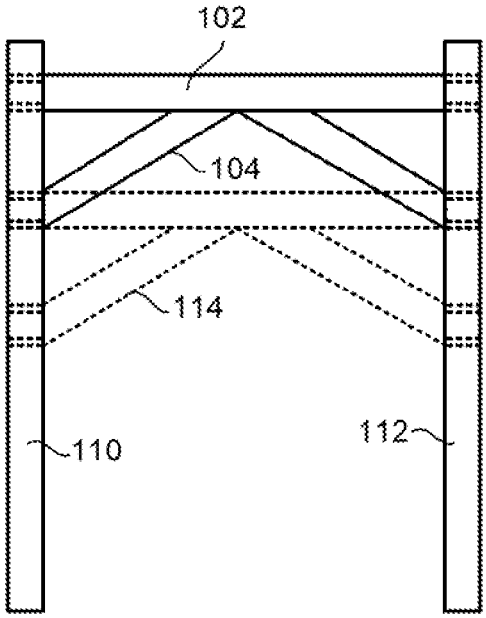
FIG. 11 is an end view of a braces spreader bar assembly as used with the trench box.

FIG. 11 shows an end view of such a configuration. In FIG. 11, the braced spreader 102 includes a linear portion and a V-shaped portion 104. As illustrated in FIG. 11, this configuration can be moved to an alternate position 114 (illustrated in broken line fashion).

Figure 12:
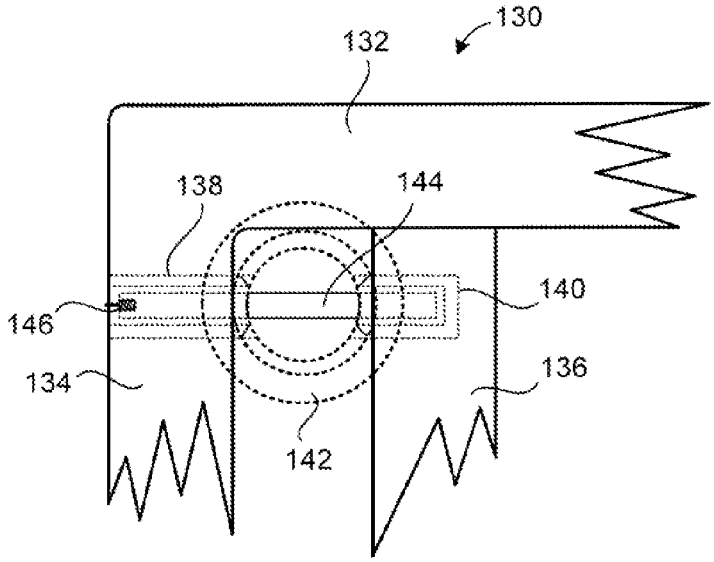
FIG. 12 is a detailed view of an alternative embodiment of the panel assembly for a trench box as used with the present invention.

FIG. 12 shows an alternative embodiment 130 of the spreader bar assembly of the present invention. As can be seen in FIG. 12, there is a horizontal member 132 and a pair of vertical members 134 and 136. A pin tube 138 extends through the vertical member 134. Another receptacle 140 extends through the vertical member 138. The flange 142 will bear against the vertical members 134 and 136 and against the horizontal member 132. The pin 144 is received in the receptacles 140 at one end and is secured within the pin tube 138 at the opposite end. A threaded receptacle 146 is positioned at the end of the pin 144 so as to receive a bolt, or other securing member, thereto.

Figure 13:
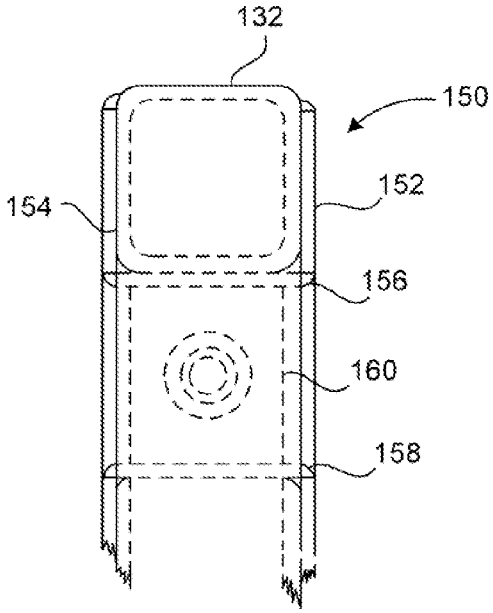
FIG. 13 is an end view of the alternative embodiment of the trench box assembly of FIG. 12.

FIG. 13 is an end view showing a corner of the trench box 150. As can be seen, the horizontal member 132 is of a box-type construction. There is an outer skin 152 formed on one side of the horizontal member 132 and an outer skin 154 formed on an opposite side of the horizontal member 132. A receptor tube 156 is diametrically fillet welded to the outer skins 152 and 154.

Figure 14:
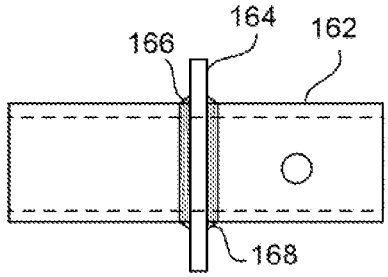
FIG. 14 is a side elevational view of the connector member having an assimilable collar thereon.

FIG. 14 illustrates the connector member 162 as used in the embodiments of FIGS. 12 and 13. As can be seen, there is a flange 164 that is secured by welds 166 and 168 to the outer surface of the connector member 162.

Figure 15:
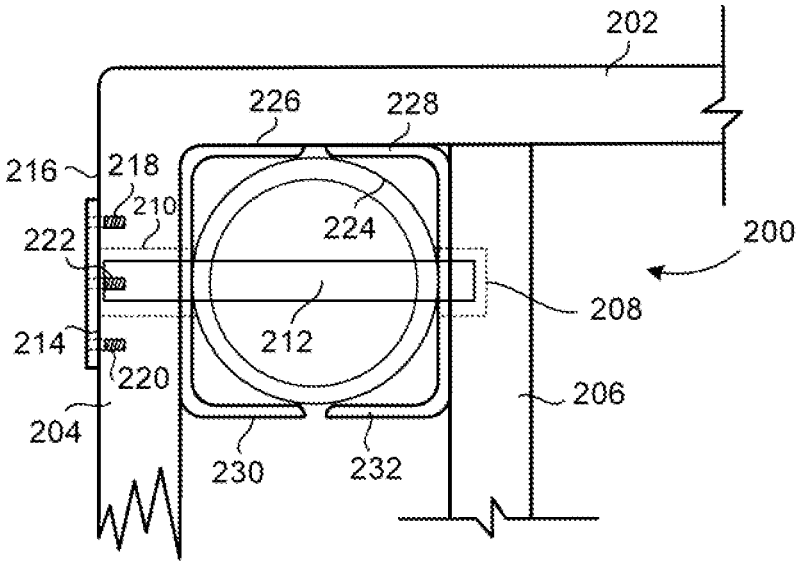
FIG. 15 is another alternative embodiment of the connector assembly as used with the panels of a trench box.

FIG. 15 illustrates another embodiment 200 of the present invention. As can be seen, there is a horizontal member 202 and vertical members 204 and 206. A receptacle 208 is affixed to the vertical member 206. A pin tube 210 extends through the vertical member 204. Pin 212 has one end secured within the receptacle 208 and an opposite end secured within the pin tube 210. A plate 214 is affixed against the outer surface 216 of the vertical member 204. Bolts 218 and 220 secure the plate 214 to the vertical member 204. Angle irons 226, 228, 230 and 232 are arranged in a rectangular configuration and are secured to surfaces of the vertical members 204 and 206 and to the horizontal member 202 by welding. As such, stronger weldment of tubular member 224 can be achieved.

Figure 16:
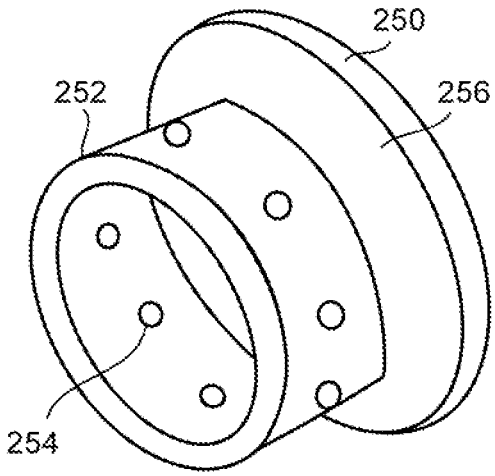
FIG. 16 is a perspective view of a removable collar that can be used in place flange associated with the connector member of the present invention.

FIG. 16 shows a removable internal ring 250 as can be used in the present invention. As can be seen, the internal ring 250 has a tubular section 252 with holes 254 formed therethrough. As such, the ring 250 can serve as a cap on the outside wall. Ring 250 would bolt inside the end of the removable collar. The flange portion 256 would rest on the outer side of the box wall. The cap could be used separately or in conjunction with a pin.

As can be seen in the present invention, the trench box 10 of the present invention can be assembled. In other words, the panels 12 and 14 can be delivered as flat panels to a desired location. The various components associated with the spreader bars (or pipes) and the connector members can be installed within the receptacle at the various corners of the panels 12 and 14 on-site. Since the panels 12 and 14 can be stacked one upon another, a large number of such panels can be delivered to a construction in a stacked configuration. The pipe and connector members can be easily retained in another container. As such, the empty spaces associated with the fixed structure of conventional trench boxes is avoided. The present invention allows a larger number of trench boxes to be delivered and stored in a given space than the prior art. Since the various components can be easily stacked, the transport of the trench boxes is much safer.

Since the various pipe and connector members of the present invention have an identical configuration, the parts can be reversed, as required. The connector member has a generally symmetrical construction. As such, it is not important which of the ends of the connector member is installed within the receptacle or within the pipe. Additionally, there is no difference in installation based upon which corner of the panels the connector members and pipes are to be positioned. As such, it is not necessary to have skilled assemblers on-site. Additionally, the various components can be manufactured in a standardized manner without the need for special adjustments between the various parts.

Another unexpected advantage of the present invention is the flexibility at the joints. The 90° relationship between the bolts, the connector members and the pipe, along with the receptacle, allows a certain amount of wiggle and wobble therebetween. Whenever it is necessary to move a trench box in which the trench box is solidly compacted within the earth, a certain amount of shaking and wiggling is required so as to loosen the frictional engagement between the walls of the excavation and the surfaces of the panels. The flexible connections at the various corners of the trench box of the present invention assures this desirable wobble. As such, a backhoe, or other piece of equipment can simply shake the trench box so as to loosen the frictional engagement of the trench box within the excavation. As such, the flexibility of the connection of the present invention achieves the ability to move the trench boxes in the excavation in a simpler, easier and more efficient manner.

The flexibility at the various joints will assure a longer life for the trench box assembly. Typically, when large forces are applied to fixed welds between the spreader bars and the panels, the welds can fracture and the sharp connections between the components can become damaged. The present invention provides a flexible connection at the joint so that these forces are more properly accommodated. Additionally, the flange 64 associated with the connector member of the present invention serves to better distribute forces to, once again, enhance the life of the trench box at these connections.

The present invention is easy to repair. If any component becomes damaged, then another component can be easily replaced on-site. It is only necessary to introduce a new connector member, and/or pipe, in order to properly repair the trench box. This will mean less downtime for the trench box assembly. The damaged collars can be easily replaced quickly.

Within the concept of the present invention, the panels 12 and 14 can be easily reversed if they should they arch from excessive ground pressure. Fore example, if the skins 90 and 92 associated with the frame members become damaged to an unacceptable extent, then the panels can simply be reversed so as to allow the panels to continue to be used, after a satisfactory repair to the skins.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A panel assembly for a trench box comprising:

a frame having an interior defined between a first skin and a second skin, said first skin and said second skin being planar members that are mechanically affixed against opposite surfaces of said frame;

a receptacle affixed within said interior of said frame, said receptacle having an interior, said receptacle being an annular member and having a first end and a second end, said first end opening through said first skin, said second end opening through said second skin;

a first connector member having one end portion removably received into one of said first and second ends of said receptacle and an opposite end portion extending outwardly of said frame, said first connector member having a flange extending radially outwardly therefrom, said flange bearing directly against at least one of said receptacle and one of said first and second skins of said frame;

a first pipe having an end affixed to said opposite end portion of said first connector member and extending outwardly therefrom, said receptacle having a hole extending diametrically thereacross, said one end portion of said first connector member having a pair of first holes extending diametrically thereacross, said pair of first holes of said first connector member being aligned with said hole of said receptacle, said first pipe having a hole extending axially diametrically thereacross, said opposite end portion of said first connector member having a pair of second holes extending diametrically thereacross in alignment with said hole of said first pipe, said end of said first pipe bearing against said flange;

a first bolt removably extending through said pair of first holes of said receptacle and through said pair of first holes at said one end portion of said first connector member so as to affix said first connector member to said receptacle; and a second bolt removably extending through said hole of said first pipe and through said pair of second holes at said opposite end portion of said first connector member so as to affix said first pipe to said first connector member, said first bolt having a longitudinal axis extending transverse to a longitudinal axis of said second bolt;

a second frame spaced apart from the frame and connected to the frame through the first pipe and first connector member;

wherein the panel assembly is placed within a trench in the soil surface.

2. A panel assembly for a trench box comprising:

a frame having an interior defined between a first skin and a second skin, said first skin and said second skin being planar members that are mechanically affixed against opposite surfaces of said frame;

a receptacle affixed within said interior of said frame, said receptacle having an interior, said receptacle being an annular member and having a first end and a second end, said first end opening through said first skin, said second end opening through said second skin;

a first connector member having one end portion removably received into one of said first end and said second end of said receptacle and an opposite end portion extending outwardly of said frame, said first connector member having a flange extending radially outwardly therefrom, said flange bearing directly against at least one of said receptacle and one of said first and second skins of said frame;

a first pipe having an end affixed to said opposite end portion of said first connector member and extending outwardly therefrom, said receptacle having a hole extending diametrically thereacross, said one end portion of said first connector member having a pair of first holes extending axially diametrically thereacross, said pair of first holes of said first connector member being aligned with said hole of said receptacle, said first pipe having a hole extending diametrically thereacross, said opposite end portion of said first connector member having a pair of second holes extending axially diametrically thereacross in alignment with said hole of said first pipe, said end of said first pipe bearing against said flange;

a first bolt removably extending through said hole of said receptacle and through said pair of first holes at said one end portion of said first connector member so as to affix said first connector member to said receptacle; and a second bolt removably extending through said hole of said first pipe and through said pair of second holes at said opposite end portion of said first connector member so as to affix said first pipe to said first connector member, said frame having a hole extending in alignment with said hole of said receptacle and with said pair of first holes at said one end portion of said first connector member, said first bolt having an end extending outwardly of said frame, said first bolt having a longitudinal axis that extends transverse to a longitudinal axis of said second bolt;

a second frame spaced apart from the frame and connected to the frame through the first pipe and first connector member;

wherein the panel assembly is placed within a trench in the soil surface.

3. A panel assembly for a trench box comprising:

a frame having an interior defined between a first skin and a second skin, said first skin and said second skin being planar members that are mechanically affixed against opposite surfaces of said frame;

a receptacle affixed within said interior of said frame, said receptacle having an interior, said receptacle being an annular member and having a first end and a second end, said first end opening through said first skin, said second end opening through said second skin;

a first connector member having one end portion removably received into one of said first end and said second end of said receptacle and an opposite end portion extending outwardly of said frame, said first connector member having a flange extending radially outwardly therefrom, said flange bearing directly against either said receptacle or one of said first and second skins; and a first pipe having an end affixed to said opposite end portion of said first connector member and extending outwardly therefrom, said first connector member being a tubular member, said one end portion of said first connector member being slidably received in said interior of said receptacle, said end of said first pipe bearing against said flange of said first connector member, said frame having a vertical member and a horizontal member affixed together so as to define a corner therebetween, said receptacle affixed in said corner;

a second frame spaced apart from the frame and connected to the frame through the first pipe and first connector member;

wherein the panel assembly is placed within a trench in the soil surface.

* * * * *